US005376025A

United States Patent [19]

Willnat et al.

[11] Patent Number: 5,376,025

[45] Date of Patent: Dec. 27, 1994

[54] FIXTURE FOR HALOGEN LAMPS

[75] Inventors: Helmut Willnat, Kierspe; Hans D. Held, Halver, both of Germany

[73] Assignee: Bender & Wirth GmbH & Co., Kierspe, Germany

[21] Appl. No.: 919,094

[22] Filed: Jul. 23, 1992

[30] Foreign Application Priority Data

Jul. 24, 1991 [DE] Germany ..... 4124470

[51] Int. Cl.[5] ..... H01R 4/48

[52] U.S. Cl. ..... 439/817; 439/683; 439/356; 313/318

[58] Field of Search ..... 313/51, 318; 439/356, 439/366, 605, 611, 612, 617, 619, 683, 689, 699, 817, 818, 819

[56] References Cited

U.S. PATENT DOCUMENTS

| | | | |
|---|---|---|---|
| 2,386,611 | 10/1945 | Ileman | 439/819 X |
| 2,392,410 | 1/1946 | Reinschmidt | 439/366 |
| 2,869,105 | 1/1959 | Pistey . | |
| 3,119,647 | 1/1964 | Flagg et al. . | |
| 4,637,677 | 1/1987 | Barkus | 439/819 X |
| 4,657,333 | 4/1987 | Anderson | 439/817 X |
| 4,927,389 | 5/1990 | Willnat | 439/682 |

FOREIGN PATENT DOCUMENTS

| | | | |
|---|---|---|---|
| 374978 | 1/1982 | Austria . | |
| 2321782 | 3/1977 | France . | |
| 0507808 | 9/1930 | Germany | 439/817 |
| 1940983 | 6/1966 | Germany . | |
| 1940985 | 6/1966 | Germany . | |
| 0024616 | of 1902 | United Kingdom | 439/356 |

OTHER PUBLICATIONS

Copy of European Search Report EP 91 11 1849.

*Primary Examiner*—Khiem Nguyen
*Attorney, Agent, or Firm*—Darby & Darby

[57] ABSTRACT

A fitting for halogen lamps of the type having plural contact pins has an insulating socket with a recess for each contact pin. Each recess confines a pivotable and reciprocable plate-like contact which is connected to a conductor and is biased by a coil spring to engage an abutment of the socket and to define therewith a wedge-like path for insertion of a contact pin. The contacts are hinged to the socket adjacent the inlets of the respective recesses, and the insertion of a contact pin into its recess results in a composite pivotal and translatory movement of the respective contact away from the adjacent abutment. The major part of the inserted contact pin is clamped between the contact and the abutment.

16 Claims, 2 Drawing Sheets

FIXTURE FOR HALOGEN LAMPS

BACKGROUND OF THE INVENTION

The invention relates to improvements in fittings for current consuming devices, and more particularly to improvements in fittings which can be utilized with advantage to connect the contact pins of halogen lamps with an energy source. Still more particularly, the invention relates to improvements and further developments of fittings of the type described and shown in commonly owned U.S. Pat. No. 4,927,389 granted May 22, 1990 to Helmut Willnat and Manfred Meichsner for "Fixture for multiple-contact pin halogen lamps". The disclosure of this patent is incorporated herein by reference.

The patent to Willnat et al. discloses a fitting which has a contact for each pin of a halogen lamp and comprises means for biasing each such contact against the respective pin to thus establish an electrical connection between the inserted pin and a conductor.

A drawback of heretofore known fittings for use in combination with halogen lamps or with other current consuming devices having plural contact pins is that the area of contact between a pin and the adjacent contact is too small to invariably guarantee the establishment of a reliable connection between the current consuming device and the terminals or poles of a source of electrical energy. For example, the contacts in certain known fittings are bent at the inlets of the recesses for reception of contact pins in order to facilitate the introduction of contact pins between the contacts and the adjacent abutments for properly inserted or fully inserted contact pins. The contact pins are relatively short so that the absence of direct engagement with contacts at the inlets is likely or bound to affect the reliability of electrical connections.

German Utility Model No. 1,940,985 to Brökelmann et al. (published Jun. 23, 1966) discloses a fixture wherein the contacts are made of resilient material and must be pushed or pulled to their retracted positions by hand in order to provide room for conductors. Once the conductors are properly inserted into the respective recesses of the socket, the contacts are released to engage the inserted conductors under the action of coil springs. The purpose of the manually movable contacts is to ensure predictable introduction of readily deformable (highly flexible) conductors into their recesses, and reliable retention of introduced conductors in response to engagement with the contacts when such contacts are released and can be acted upon by the respective springs. The contacts must be retracted by hand against the opposition of the respective springs if a person in charge wishes to extract the conductors from their recesses in the socket.

German Utility Model No. 1,940,983 of Brökelmann et al. (published Jun. 23, 1966) discloses a fitting for conductors which extend beyond the ends of the jackets of cables and are to be clampingly engaged by polygonal resilient contacts in the respective recesses of a socket. The inserted conductor is clamped by the adjacent polygonal contact and is biased against a second contact which is fixedly installed in the socket. The manner in which the inserted and clamped conductor is to be connected with the contact pins of lamps or the like is not disclosed. A properly inserted conductor is confined in a channel between the two contacts.

U.S. Pat. No. 2,869,105 granted Jan. 13, 1959 to Pistey discloses a bi-pin fluorescent lamp holder. The patentee is concerned primarily with the attachment of lead wires to contacts in the lamp holders. The contact pins of the fluorescent lamp are removably inserted into the respective lampholders by turning the envelope of the lamp until the contact pins snap into recesses which are provided therefor in pairs of V-shaped notches of the contacts. The contact pins maintain the contacts in stressed condition but are not urged against any abutments while in inserted positions.

OBJECTS OF THE INVENTION

An object of the invention is to provide a novel and improved fixture which can establish a reliable electrical connection between the contact pins of a halogen lamp or another current consuming device and the lead wires or conductors which serve to connect the lamp to a source of electrical energy.

Another object of the invention is to establish a large-area contact between the contact pins and the electric contacts in a fixture for halogen lamps or the like.

A further object of the invention is to provide a simple and inexpensive fixture which comprises a small number of parts and wherein the contacts are mounted in a novel and improved way.

An additional object of the invention is to provide novel and improved contacts for use in the above outlined fixture.

Still another object of the invention is to provide a novel and improved method of installing the contacts in the socket of the above outlined fixture.

A further object of the invention is to provide a novel and improved socket for use in the above outlined fixture.

An additional object of the invention is to provide a fixture which renders it possible to properly retain contact pins having diameters or thicknesses which vary within a wide range.

Another object of the invention is to provide a novel and improved connection between the socket and the contacts of the above outlined fixture.

Still another object of the invention is to provide a novel and improved method of confining springs and contacts in the socket of the above outlined fixture.

A further object of the invention is to provide a fixture which can be utilized as a superior substitute for heretofore known fixtures for the contact pins of halogen lamps and like consumers of electric energy having a plurality of contact pins.

Another object of the invention is to provide a fixture which can accept the contact pins of many presently available types of halogen lamps and the like.

SUMMARY OF THE INVENTION

The invention resides in the provision of a fixture for current consuming devices, such as halogen lamps of the type having plural contact pins. The improved fixture comprises a socket made at least in part of insulating material and having recesses for contact pins as well as an abutment in at least one of the recesses. The fixture further comprises an electrical connector for each of the recesses, and at least one of these connectors comprises a substantially plate-like contact which is movably installed in the at least one recess, means for biasing the contact toward the abutment, and means for holding the contact in a position of inclination relative to the abutment in the absence of a contact pin in the at least one recess between the abutment and the contact. The insertion of a contact pin between the contact and the abutment results in a change of inclination of the contact relative to the abutment against the opposition or resistance of the biasing means so that the contact is then biased against the inserted contact pin which, in turn, is biased against the abutment.

The abutment has a first surface and the contact has a second surface which confronts the first surface and is inclined relative to the first surface in the absence of a contact pin in the at least one recess between the two surfaces. A contact pin which is inserted into the at least one recess is located between the surface of the contact and the surface of the abutment. The at least one recess has an inlet for the introduction of a contact pin, and the two surfaces preferably define for a contact pin a path which narrows in a direction away from the inlet and is widened in response to insertion of a contact pin between the two surfaces. The path preferably includes a first portion which is adjacent the inlet and has a first width, and a second portion which is remote from the inlet and has a second width less than the first width and less than the thickness of a contact pin so that insertion of a contact pin into the path results in a widening of the second portion of the path against the opposition or resistance of the biasing means.

The holding means is preferably installed adjacent the inlet of the at least one recess and the biasing means preferably acts upon the contact at a location which is remote from the inlet. The holding means can include bearings which are provided in or on the socket, and pivots which are provided on the contact and extend into the bearings with at least some clearance to thus enable the contact to perform translatory and pivotal movements relative to the abutment, To this end, the bearings (which can be of one piece with the socket) have openings which loosely receive the pivots of or on the contact. The arrangement may be such that the pivots bear upon the bearings under the action of gravity, and the biasing means is preferably disposed at a level below the bearings.

The width of the aforementioned first portion of the path is preferably slightly less than the thickness of a contact pin (i.e., the diameter of a round contact pin). This ensures that each portion of the path must be widened in response to insertion of a contact pin into the path between the contact and the abutment in the at least one recess.

The aforementioned bearings and pivots can be said to constitute a hinge which is preferably adjacent the inlet of the at least one recess. The biasing means can comprise a spring (e.g., a coil spring) which acts upon the contact (either directly or indirectly) at a location more distant from the inlet than the hinge. The hinge defines for the contact a pivot axis and the spring acts upon the contact to pivot the latter about the axis toward the abutment. The hinge comprises the aforementioned bearings which (as mentioned above) can form part of the socket or are installed in the socket, and wings (the aforementioned pivots) which are provided on the contact and are pivotably received in the bearings with sufficient clearance to permit translatory and pivotal movements of the contact relative to the abutment.

The biasing means comprises a first portion which is adjacent the contact, and the contact can comprise a portion which at least partially confines the first portion of the spring. A second portion of the spring reacts against the socket to urge the confined first portion of the spring against or toward the contact. The confining portion of the contact can include a prong or tongue which is of one piece with a substantially plate-like main portion of the contact.

The housing of a halogen lamp which has pins receivable in the recesses of the socket can be releasably coupled to the socket. The means for coupling the housing to the socket can comprise a substantially U-shaped resilient clamp having a pair of legs or extensions which flank the socket. The legs of the clamp have first detent members and the housing has second detent members which are complementary to and releasably engage with the first detent members. Each leg of the clamp can comprise a plurality of sections (e.g., each leg can include a bifurcated portion with two prongs constituting the respective sections), and each such section can be provided with a first detent member. The detent members of the legs can snap into the detent members on the housing of the lamp.

The novel features which are considered as characteristic of the invention are set forth in particular in the appended claims. The improved fixture itself, however, both as to its construction and the mode of utilizing the same, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
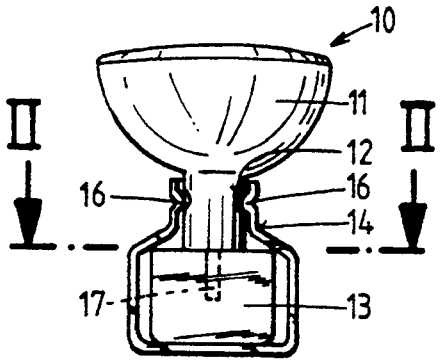
FIG. 1 is a schematic elevational view of a halogen lamp having pins extending into the recesses of a socket forming part of a fixture which embodies one form of the present invention, the housing of the lamp being releasably coupled to the socket by a U-shaped clamp.

FIG. 1 shows a current consuming device 10 which constitutes a halogen lamp having a reflector housing 11 and two contact pins 17 (one shown in each of FIGS. 1, 6 and 7) which extend into discrete recesses 18 in a socket 13. The housing 11 has female detent members 12 which are located substantially diametrically opposite each other and serve to receive portions of male detent members 16 provided on the legs of a substantially U-shaped resilient clamp 14 which serves to separably couple the housing 11 to the socket 13. The latter is made, at least in part, of an electrically insulating material and three of its sides are surrounded by the clamp 14. In FIG. 1, the base or web of the U-shaped clamp 14 is adjacent the underside of the socket 13 and each of the two legs of the clamp is slotted at least close to its upper end to form two sections or prongs 15 each of which has a male detent member 16 extending into the adjacent female detent member 12 of the housing 11. This ensures reliable retention of the socket 13 in requisite position relative to the reflector housing 11 as a result of engagement of four spaced apart male detent members 16 with the adjacent female detent members 12. Each leg of the clamp 14 can include or constitute a single prong 15, or each such leg can comprise three or more prongs 15.

Figure 2:
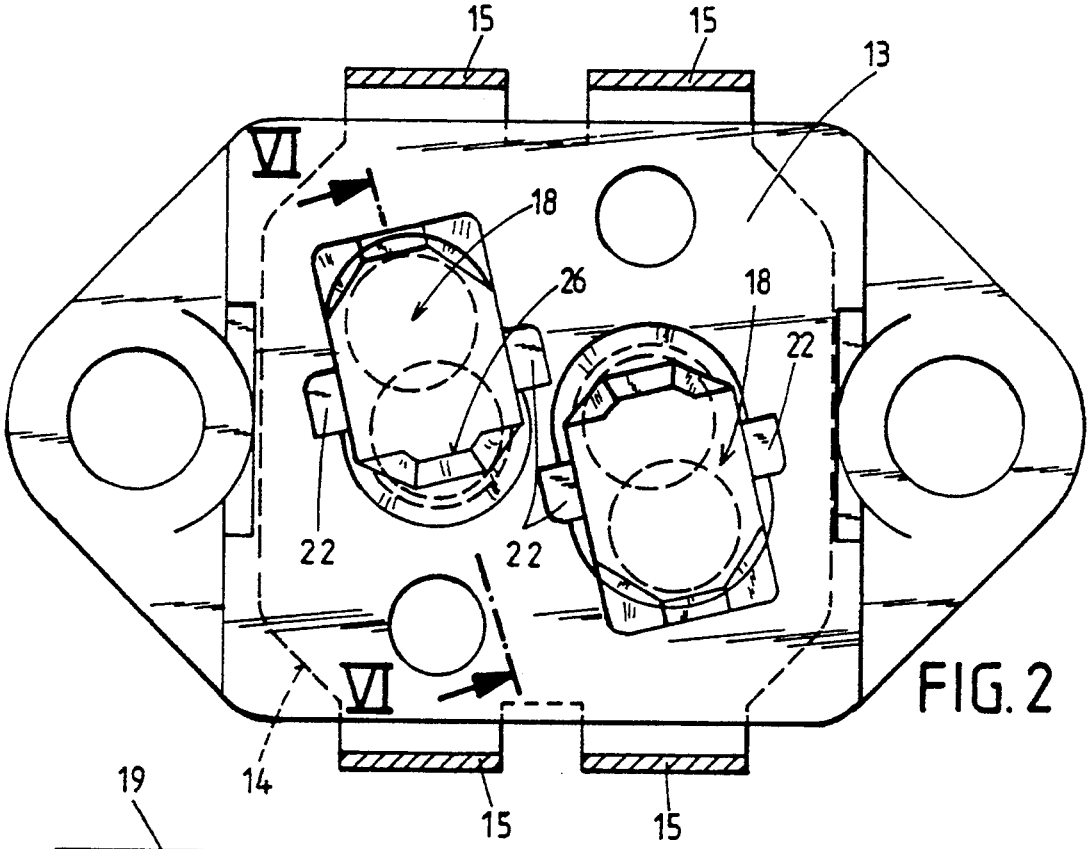
FIG. 2 is an enlarged sectional view substantially as seen in the direction of arrows from the line II—II in FIG. 1, with the lamp omitted.

FIG. 2 shows the upper side of the socket 13 of FIG. 1, with a plate-like cover 21 (FIGS. 6 and 7) omitted. The socket 13 has two recesses 18 each of which receives one of the two contact pins 17 when the reflector housing 11 of the halogen lamp 10 is properly clamped to the socket in a manner as shown in FIG. 2. Each recess 18 receives a discrete electrical connector having a plate-like contact 19 of current conducting material, a coil spring 20 which serves to bias the contact 19 toward an abutment 26 forming an integral part of the socket 13, and a cable 27 having a conductor or lead wire 29 with a bare end portion which is biased against or is welded or soldered to the left-hand side or surface of the contact 19, namely to that side or surface which faces away from the abutment 26. The abutment 26 has a plane surface 30 which confronts the surface 31 of the contact 19 and defines therewith a wedge-like path 32 when the recess 18 does not receive a contact pin 19.

Figure 6:
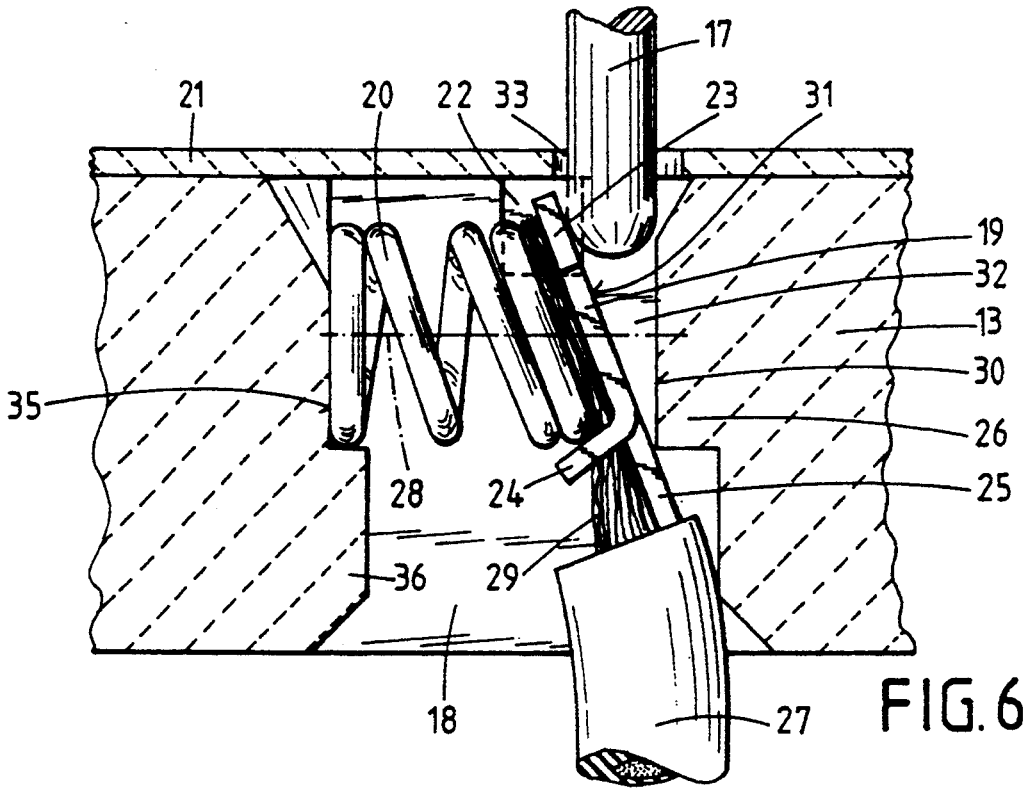
FIG. 6 is an enlarged fragmentary sectional view substantially as seen in the direction of arrows from the line VI—VI of FIG. 2, a contact pin being shown in a position in which it is ready to advance between the surfaces of the abutment and the contact.
Figure 7:
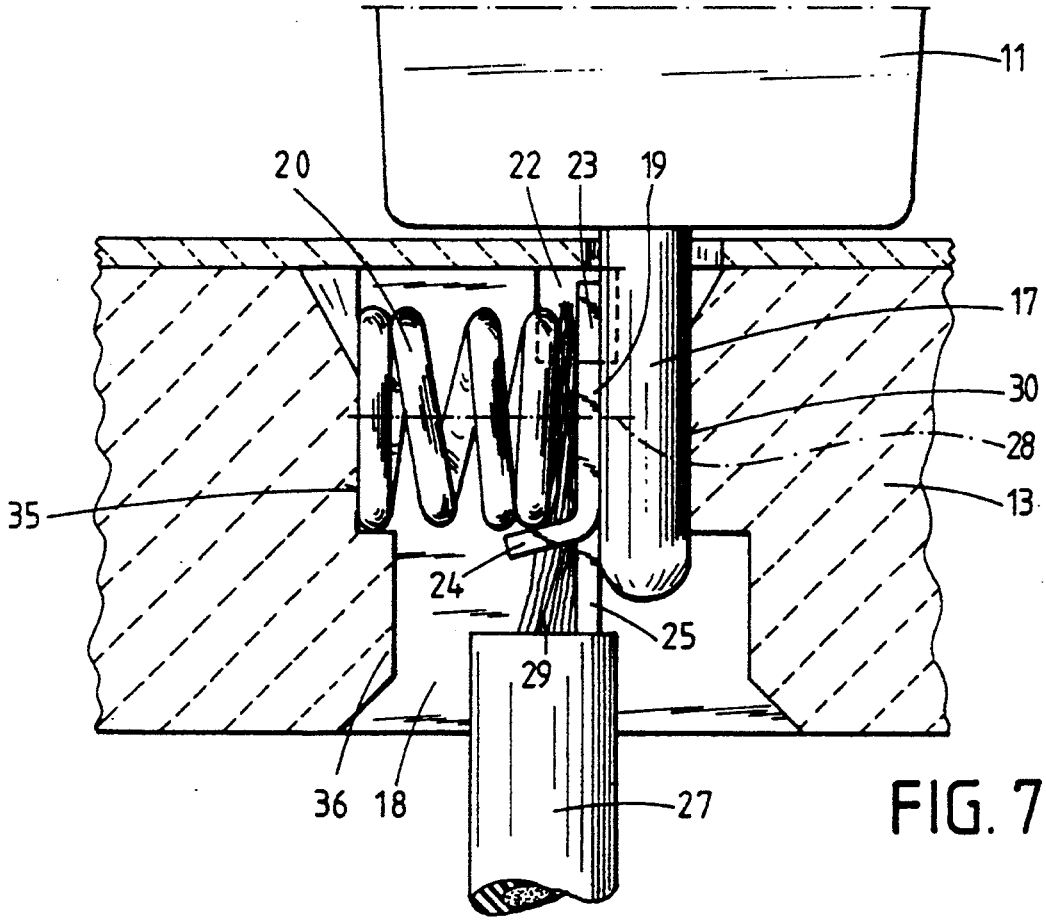
FIG. 7 is a similar sectional view but showing the contact in a different position upon insertion of a contact pin through the inlet of the respective recess in the socket.

The plate-like cover 21 of the socket 13 has two openings 33 each of which constitutes the inlet of the adjacent recess 18 and is dimensioned in such a way that it can receive a contact pin 17 with a certain amount of clearance (see FIGS. 6 and 7).

Figure 3:
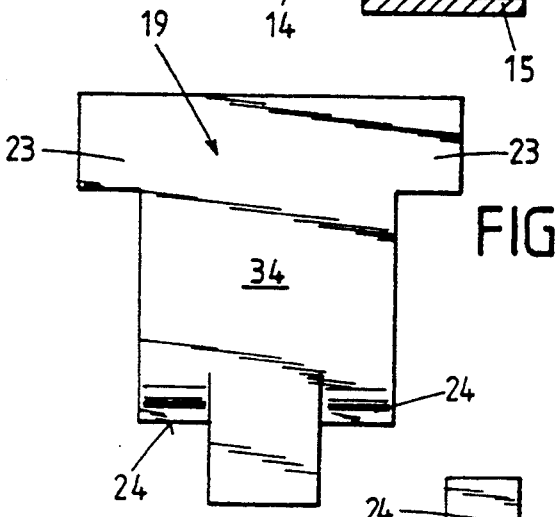
FIG. 3 is an enlarged front elevational view of a contact forming part of an electrical connector for one contact pin of the halogen lamp.
Figure 4:
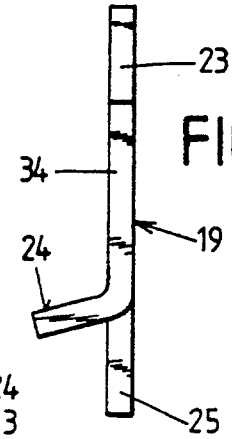
FIG. 4 is a side elevational view of the contact substantially as seen from the right-hand side of FIG. 3.
Figure 5:
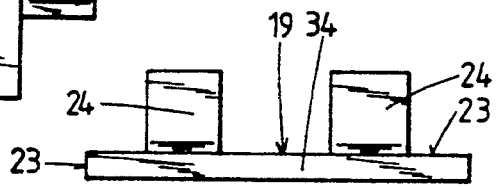
FIG. 5 is a plan view of the contact which is shown in FIGS. 3 and 4.

A presently preferred form of contacts 19 is shown in FIGS. 3, 4 and 5. The illustrated contact 19 includes a plate-like main portion 34 which is of one piece with two pivots or wings 23 and with a two-piece spring confining portion 24 which is bent out of the plane of the main portion 34 in a direction away from the respective abutment 26 (see FIGS. 6 and 7). The main portion 34 includes a planar or substantially planar extension 25 which serves to enlarge the area of contact between the conductor 29 and the contact 19. The pivots or wings 23 of each contact 19 can be said to constitute a two-piece pintle of a hinge which serves to movably mount the contact in the respective recess 18 adjacent the cover 21. The hinge further comprises two bearings which are integral parts of the socket 13 and have polygonal openings 22 adjacent the respective inlets 33 and receiving the respective wings or pivots 23 with a certain amount of clearance so that each contact 19 is free to perform pivotal movements relative to as well as translatory movements toward and away from the respective abutment 26. In the absence of a contact pin 17 in the respective path 32, the adjacent end portion of the coil spring 20 in the respective recess 18 causes the contact 19 to assume an inclined position relative to the abutment 26 (see FIG. 6) such that the width of the path 32 is greater at the inlet 33 (i.e., at the bearings including the openings 22) and less at a distance from the inlet 33. The rear end convolution of the coil spring 20 reacts against a surface 35 of the socket 13 in the respective recess 18. The socket 13 further comprises platforms 36 for the rear convolutions of the springs 20. The reference character 28 denotes in FIGS. 6 and 7 the axis of the respective spring 20 and the resultant of forces which the foremost convolution of such spring transmits to the adjacent side or surface of the main portion 34 of the contact 19 in order to maintain the main portion 34, the extension 25 and the wings or pivots 23 in a plane which is inclined relative to the surface 30 of the respective abutment 26. At such time, the wings or pivots 23 are located in or close-to the right-hand portions of the respective openings 22.

The two halves or prongs of the spring confining portion 24 cooperate with the main portion 34 of the contact 19 to confine the adjacent foremost convolution of the spring 20 in a manner as shown in FIGS. 6 and 7. The portion 24 further cooperates with the platform 36 in the respective recess 18 to maintain the spring 20 in an optimum position in which the spring reacts against the surface 35 and bears against the main portion 34 of the contact 19 to maintain the latter in the orientation of FIG. 6 prior to insertion of a contact pin 17.

The extensions 25 of the contacts 19 serve the additional purpose of determining the distance of the adjacent ends of the jackets of cables 27 from the cover 21 and from the level of the wings or pivots 23.

When the hemispheric tip of a round (cylindrical) contact pin 17 is about to be inserted into the recess 18 of FIGS. 6 and 7, the width of the path 32 at the inlet 33 is slightly less than the thickness (diameter) of the pin 17. On the other hand, the width of that portion of the path 32 which is distant from the inlet 22 is much less and actually zero because FIG. 6 shows that the surface 31 of the contact 19 can actually engage the surface 30 of the abutment 26. Such configuration of the path 32 (in the absence of a contact pin 17 between the surfaces 30 and 31) ensures that the tip of the contact pin 17 begins to pivot and/or shift the contact 19 relative to the openings 22 as soon as the pin begins to descend to a level below that which is shown in FIG. 6. When the pin 17 reaches the fully inserted position of FIG. 7, the contact 19 has completed a combined pivotal and translatory movement relative to the socket 13, and its surface 31 is substantially parallel to the surface 30 (it being assumed that the diameter of the pin 17 is constant). The spring 20 causes the surface 31 of the contact 19 to bear against the inserted pin 17, and the inserted pin is caused to bear against the surface 30 of the abutment 26. The cable 27 and its conductor 29 are shifted toward the center of the lower portion of the recess 18, as viewed in FIG. 7.

If the openings 22 of the bearings for the wings or pivots 23 of the contact 19 are located at a level above the spring 20, the contact 17 exhibits a tendency to descend by gravity (in the absence of the spring 20) until intercepted by the bearings including the openings 22. Pivoting of the contact 19 relative to the abutment 26 begins not later when the contact pin 17 reaches the level of the axis 28 on its way from the position of FIG. 6 toward the position of FIG. 7.

The cover 21 ensures that the contacts 19 and the springs 20 cannot leave their respective recesses 18. In addition, the cover 21 cooperates with the platforms 36 and abutments 26 to ensure that the springs 20 and the respective contacts 19 are maintained in optimum positions (shown in FIG. 6) for insertion of contact pins 17 and for the establishment of a reliable connection between the inserted pin 17 and the corresponding conductor 29. The openings 22 can constitute recesses which are provided in the upper side of the socket 13 and are overlapped by the cover 21.

The prongs of the inclined portion 24 of each contact 19 can serve the additional function of properly positioning the strands of the conductor or lead wire 29 during welding or soldering of such strands to the main portion 34 of the contact.

An important advantage of the improved fixture is that the spring 20 cooperates with the hinge including the wings or pivots 23 and with the abutment 26 to maintain the contact 19 in the inclined position of FIG. 6 prior to introduction of the contact pin 17. This establishes the aforediscussed substantially wedge-like path 32 which ensures that the contact 19 is pivoted as the insertion of the pin 17 into the recess 18 proceeds. At the same time, the hinge including the wings or pivots 23 enables the contact 19 to perform a combined pivotal and translatory movement which, in turn, ensures that the main portion 34 and the extension 25 of the contact 19 are maintained in large-area engagement with the inserted pin 17 without the need for screws or other types of fasteners. The abutment 26 cooperates with the contact 19 to ensure that at least the major portion of the inserted pin 17 is in contact with the main portion 34 and with the extension 25. The spring 20 ensures that such large-area engagement remains intact for as long as the pin 17 extends into the respective recess 18.

Another advantage of the improved fixture is its simplicity. Thus, the number of parts need not exceed the number of parts in a conventional fixture and the construction of the socket 13, spring 20 and contact 19 is such that these parts can be assembled in automatic machines. The major part of the contact 19 need not be bent and/or otherwise shaped but can remain flat without affecting its ability to cooperate with the abutment 26 to reliably engage and retain a contact pin 17.

If the width of that portion of the path 32 which is adjacent the inlet 22 is selected in such a way that it is only slightly less than the thickness (diameter) of a contact pin 17 which is to be received in the respective recess 18, the initial stage of insertion of the contact pin entails primarily a pivotal movement of the contact 19 against the resistance of the spring 20. At such time, the wings or pivots 23 exert no pressure, or exert a minimal pressure, against the surfaces bounding the openings 22. The spring 20 ensures that the contact 19 is maintained in uninterrupted engagement with the advancing contact pin 17 and that the extent of such engagement increases as the pin 17 continues to advance from the position of FIG. 6 to the position of FIG. 7. The placing of the spring 20 at a distance from the inlet 33 which is greater than that of the hinge including the pivots or wings 23 ensures that the spring 20 can cooperate with the hinge and with the abutment 26 to maintain the contact 19 in the inclined position of FIG. 6 as soon as the contact pin 17 is extracted from the recess 18 and for as long as the pin remains outside of such recess.

The illustrated wings 23 constitute a presently preferred form of pivots because they render it possible to mass produce the contacts 19 at a low cost. In addition, such wings are capable of ensuring controlled shifting and pivoting of the contact 19 as soon as they are properly received in the respective openings 22.

The clamp 14 constitutes the presently preferred means for releasably coupling the socket 13 with the reflector housing 11 of the lamp 10. An advantage of this clamp is that the socket 13 is reliably confined between the web of the clamp and the housing 11 even if the detent members 12 and 16 are not machined or otherwise formed with a very high degree of precision. Thus, a reliable connection between the housing 11 and the socket 13 is established even if one of the male detent members 16 is not fully received in or does not enter the adjacent female detent member 12.

The improved fixture is susceptible of additional modifications without departing from the spirit of the invention. For example, the flat strip-shaped wings 23 of each contact 19 can be replaced by a pair of cylindrical pivots. Furthermore, the socket 13 can be provided with two pairs of substantially L-shaped or V-shaped grooves which replace the openings 22. One arm of each such groove serves to guide a wing 23 or an equivalent pivot during introduction of a contact pin 17 into the respective recess 18, and the other arm of each groove thereupon receives the respective wing 23 or an equivalent pivot to ensure that the pivot is properly retained in the socket and that the respective contact 19 is free to perform translatory and/or pivotal movements relative to the socket.

The two-piece prongs 24 can be replaced with retainers which extend into the front convolutions of the respective springs 20 to thus even more accurately confine the springs to engagement with selected portions of the adjacent contacts 19 or conductors 29 so that the contacts are compelled to assume the aforediscussed inclined positions which are best suited to ensure predictable introduction of contact pins 17 and the establishment of reliable electrical connections between the inserted pins and the respective conductors 29.

The illustrated coil springs 20 can be replaced with biasing means in the form of V-shaped leaf springs or with otherwise configurated springs. Furthermore, each contact 19 can be biased by two or more springs.

The halogen lamp 10 of FIG. 1 constitutes but one of numerous types of current consuming devices which can be connected to an energy source by resorting to the fitting of the present invention. For example, the housing 11 of the halogen lamp 10 can be omitted if the halogen lamp merely comprises an envelope of glass and a plurality of contact pins which extend from the envelope.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A fixture for current consuming devices, particularly for halogen lamps with plural contact pins, comprising a socket having recesses for contact pins and an abutment in at least one of said recesses; and an electrical connector for each of said recesses, at least one of said connectors comprising a substantially flat plate-line contact movably installed in said at least one recess, wherein said abutment has a first surface and said contact has a second surface which confronts said first surface and is inclined relative to said first surface in the absence of a contact pin in said at least one recess between said surfaces, a contact pin which is inserted into said at least one recess being located between said surfaces, and wherein said at least one recess has an inlet for introduction of a contact pin and said surfaces define for a contact pin a path which narrows in a direction away from said inlet and is widened in response to insertion of a contact pin between said surfaces;

means for biasing said contact toward said abutment, and means for holding the entire contact in a position of inclination relative to said abutment in the absence of a contact pin in said at least one recess between said abutment and said contact, wherein said holding means includes bearings provided in said socket and pivots provided on said contact and extending into said bearings with clearance enabling said contact to perform translatory and pivotal movements relative to said abutment, the insertion of a contact pin between said contact and said abutment resulting in a change of inclination of the entire contact relative to said abutment against the opposition of said biasing means so that the contact is biased against and is in large area contact with the inserted contact pin.

2. The fixture of claim 1 for current consuming devices with contact pins having a predetermined thickness, wherein said path includes a first portion adjacent said inlet and having a first width and a second portion remote from said inlet and having a second width less than said first width and less than said predetermined thickness so that insertion of a contact pin into said path results in a widening of said second portion of said path against the opposition of said biasing means.

3. The fixture of claim 2, wherein said holding means is adjacent said inlet and said biasing means acts upon said contact at a location which is remote from said inlet.

4. The fixture of claim 1, wherein said bearings have openings loosely receiving said pivots.

5. The fixture of claim 1, wherein said pivots bear upon said bearings under the action of gravity, said biasing means being disposed at a level below said bearings.

6. The fixture of claim 1 for current consuming devices with contact pins having a predetermined thickness, wherein said path includes a first portion adjacent said inlet and having a first width slightly less than said predetermined thickness and a second portion distant from said inlet and having a second width less than said first width so that each of said portions of said path is widened in response to insertion of a contact pin between said contact and said abutment.

7. The fixture of claim 1, wherein said holding means comprises a hinge which is adjacent said inlet, said biasing means comprising a spring which acts upon said contact at a location more distant from said inlet than said hinge, said hinge defining for said contact a pivot axis and said spring acting upon said contact to pivot the contact about said axis toward said abutment.

8. The fixture of claim 7, wherein said hinge comprises bearings in said socket and wings provided on said contact and pivotably received in said bearings.

9. The fixture of claim 1, wherein said biasing means comprises a portion which is adjacent said contact and said contact comprises a portion which confines said portion of said biasing means.

10. The fixture of claim 9, wherein said biasing means comprises a second portion which reacts against said socket to urge said confined portion toward said abutment.

11. The fixture of claim 9, wherein said portion of said contact includes at least one prong of one piece with a plate-like main portion of said contact.

12. The fixture of claim 1 for a halogen lamp having a housing, further comprising means for releasably coupling said socket to the housing of a halogen lamp.

13. The fixture of claim 12, wherein said coupling means comprises a substantially U-shaped resilient clamp having a pair of legs flanking said socket, said legs having first detent members and the housing having second detent members complementary to and releasably engaging with said first detent members.

14. The fixture of claim 13, wherein each of said legs has a plurality of sections and each of said sections includes a first detent member.

15. A fixture for current consuming devices, particularly for halogen lamps with plural contacts, comprising a socket having recesses for contact pins and an abutment in at least one of said recesses; and an electrical connector for each of said recesses, at least one of said connectors comprising a substantially plate-like contact movably installed in said at least one recess, said abutment having a first surface and said contact having a second surface which confronts said first surface and is inclined relative to said first surface in the absence of a contact pin in said at least one recess between said surfaces, a contact pin which is inserted into said at least one recess being located between said surfaces and said at least one recess having an inlet for introduction of a contact pin and said surfaces defining for a contact pin a path which narrows in a direction away from said inlet and is widened in response to insertion of a contact pin between said surfaces, said at least one connector further comprising means for biasing said contact toward said abutment and means for holding said contact in a position of inclination relative to said abutment in the absence of a contact pin in said at least one recess between said abutment and said contact, the insertion of a contact pin between said contact and said abutment resulting in a change of inclination of said contact relative to said abutment against the opposition of said biasing means so that the contact is biased against the inserted contact pin, said holding means comprising a hinge which is adjacent said inlet and said biasing means comprising a spring which acts upon said contact at a location more distant from said inlet than said hinge, said hinge defining for said contact a pivot axis and said spring acting upon said contact to pivot the contact about said axis toward said abutment, said hinge comprising bearings in said socket and wings provided on said contact and pivotably received in said bearings.

16. A fixture for current consuming devices, particularly for halogen lamps with plural contact pins, comprising a socket having recesses for contact pins and an abutment in a t least one of said recesses; and an electrical connector for each of said recesses, at least one of said connectors comprising a substantially flat plate-line contact movably installed in said at least one recess;

means for biasing said contact toward said abutment, and means for holding the entire contact in a position of inclination defining a gradually constricted opening relative to said abutment in the absence of a contact pin in said at least one recess between said abutment and said contact, wherein said holding means includes bearings provided in said socket and pivots provided on said contact and extending into said bearings with clearance enabling said contact to perform translatory and pivotal movements relative to said abutment, the insertion of a contact pin between said contact and said abutment resulting in a change of inclination of the entire contact relative to said abutment against the opposition of said biasing means so that the contact is biased against and is in large area contact with the inserted contact pin.

* * * * *